US011352175B2

(12) United States Patent
Dabbur

(10) Patent No.: US 11,352,175 B2
(45) Date of Patent: Jun. 7, 2022

(54) CLOSURE METHOD OF BOTTLE AND BOTTLE

(71) Applicant: AL IBTIKAR PACKAGING & INVESTMENT CO., LTD., The West Bank (PS)

(72) Inventor: Ismail Omar Dabbur, The West Bank (PS)

(73) Assignee: AL IBTIKAR PACKAGING & INVESTMENT CO., LTD., The West Bank (PS)

( * ) Notice: Subject to any disclaimer, the term of this patent is extended or adjusted under 35 U.S.C. 154(b) by 53 days.

(21) Appl. No.: 16/691,852

(22) Filed: Nov. 22, 2019

(65) Prior Publication Data

US 2021/0155381 A1 May 27, 2021

(51) Int. Cl.
*B65D 41/34* (2006.01)

(52) U.S. Cl.
CPC ..... *B65D 41/3428* (2013.01)

(58) Field of Classification Search
CPC ..... B65D 41/3428
See application file for complete search history.

(56) References Cited

U.S. PATENT DOCUMENTS

2010/0084364 A1* 4/2010 Martin ..... B65D 41/34 215/201
2016/0023813 A1* 1/2016 Dabbur ..... B65D 41/34 215/251

* cited by examiner

*Primary Examiner* — Nathaniel C Chukwurah
*Assistant Examiner* — Lucas E. A. Palmer
(74) *Attorney, Agent, or Firm* — Sughrue Mion, PLLC

(57) ABSTRACT

Safe and sealed closure method for the neck of a bottle, wherein the stopper (1) used and the container (2) to be closed are such that they form one integral part (5) upon closing of the container with the stopper via engagement by entry of a safety strip (6) of said stopper into a part (4) positioned on the container's neck such that the safety strip enters into the part of the container neck in one irreversible way, making the safety strip and the part one integral, non-detachable part or by entry of a safety strip positioned on the container's neck into a part of said stopper such that the safety strip enters into the part of the stopper in one irreversible way, making the safety strip and the part one integral, non-detachable part, wherein said safety strip or said part is attached to a safety seal band (8) of the stopper at an end of the safety seal band, wherein the safety seal band is attached to the whole circumference of the stopper when closed and wherein the safety seal band partially detaches from the stopper upon opening the bottle from opening points keeping the stopper attached to the container.

4 Claims, 5 Drawing Sheets

CLOSURE METHOD OF BOTTLE AND BOTTLE

FIELD OF THE INVENTION

The present invention relates to a closure method of a bottle and a bottle, that is, relates to the safety of e.g. bottled beverages, food and medical products, such that it is not possible to open and close the bottle again in a sealable and safe manner as it was handled in the first time, for keeping the safety of product and health of the consumer.

BACKGROUND

The present invention arises from the need for keeping beverages, food and medical products safe and keeping them tamper proofed and ensuring safety and health of a consumer which is not available now, after proving weaknesses and defects of a closure method for containers of different kinds and shapes. That is, any person can open any container, very simply and easily, and close it back as it was before with no marks indicating opening of the container and tampering it, thus making a common safety seal band available in the market ineffective. There might be severe risk on the health and safety of a consumer worldwide, which necessitates providing an alternative solution absolutely effective and safe, thus keeping a product safe and keeping safety and health of consumer. What has been achieved in this invention is the impossibility of opening and reclosing a container such that it assumes the previous state in any manner, wherein in any case of attempting to open the container in a conventional or indirect way, the seal gets damaged and cannot be reused as it was first when provided with the safety seal band, as it was first produced.

EP 3 166 863 B1 and WO 2013/120617 A2 each disclose a safe and sealed closure method for the neck of a food and medical bottle, wherein the stopper used and the container to be closed are such that they form one integral part upon closing of the container with the stopper via engagement so that the stopper is engaged with the container.

SUMMARY OF THE INVENTION

According to the present invention, a safe and sealed closure method as defined in claim 1 is provided. A bottle according to the present invention is provided in claim 4. The dependent claims show some examples of the method.

The invention relates to safety of medical and food products currently available in the markets which are characterized by a closure method and a bottle which are inadequate and do not fulfill the need for safety due to said drawbacks. Thus, there is a need to amend and change the closure method and bottle to achieve the desired full safety of the bottled products.

The previously mentioned drawback is that the stopper (e.g. cap or bottle cap) and the container (e.g. part of the bottle) are two separate parts and upon closure of the container provided with an appropriate stopper they form two combined overlapped bodies so that the stopper closes the container in a sealed, but unsafe manner so that one can separate them from each other in a manner other than normal opening, i.e. by heating the stopper so that it gets detached from the container after expansion and by returning it back to its original position with a safety seal band as it was produced such that it can be reused again. Further, the neck of the bottle can be internally heated, detaching the stopper and the safety seal band from the bottle and by returning it back to its original position and reusing it several times. Thus, the container's content is at risk of being easily tampered with.

Therefore the optimal solution provided by this invention is to make the two bodies, i.e. the container and stopper, one body upon the closure of the container with the stopper by engagement such that the stopper engages with the container by inserting and engaging a safety strip of the stopper into another part (e.g. a receptacle) of the container forming one interposing and integral part (e.g. safety element) undetectable unless either the stopper, the container or both are tampered with, which makes it difficult to use them again as they were first produced. Moreover, said two bodies, the container and the stopper, might still be attached upon opening by a safety seal band that attaches the container and the stopper together. Said band may be attached to the container by interposing the safety strip between said band (e.g. inner wall of the band) and a wall of the neck of the container. This band connects the two bodies and it also enables the stopper to move rotationally while connected to the container. By this method of forming one integral part of the stopper and the container upon closure and opening, the closure is safe, i.e., a first time opening will be detectable, and cannot be reused again to avoid risks and, further, after opening, the stopper will still be attached by the band to the container.

That is, when the bottle is closed by the stopper, the safety strip cannot be reached, e.g. even when using small and narrow tools, due to its location between said band (e.g. inner wall thereof) and the wall of the neck of the container and prevents removal of the stopper e.g. by heating the stopper due to the engagement of the safety strip and the part. Further, when the bottle is opened by rotating the stopper, the safety strip and the part remain engaged and the safety seal band partially detaches from the stopper from opening points (e.g. rated breaking points) still keeping the stopper (e.g. loosely) attached to the container thereby preventing loss of the stopper.

DETAILED DESCRIPTION

The present invention relates to a safe and sealed closure method for the neck of a bottle, e.g. food, beverage or medical bottle, via engagement of a safety strip of a stopper into a part of the bottle's neck (or vice versa) to be closed to tightly seal the container and product to deliver it safely to the consumer thus preventing occurrence of tampering after manufacturing the product and coming out of the plant. In this way, the original product can be delivered with its desired quality to the consumer without any amendments in the product. The parts overlapping each other may be present at either one of the stopper and the neck of the bottle to achieve absolute closure, and a safety seal band is provided at the stopper which upon opening of the bottle attaches the stopper and bottle's neck as shown in the Figures. Although not explicitly described or shown, the stopper includes inner threads corresponding to outer threads of the neck of the bottle for a threaded engagement of the stopper and the neck of the bottle when closing and opening the bottle via rotation of the stopper.

Figure 1:
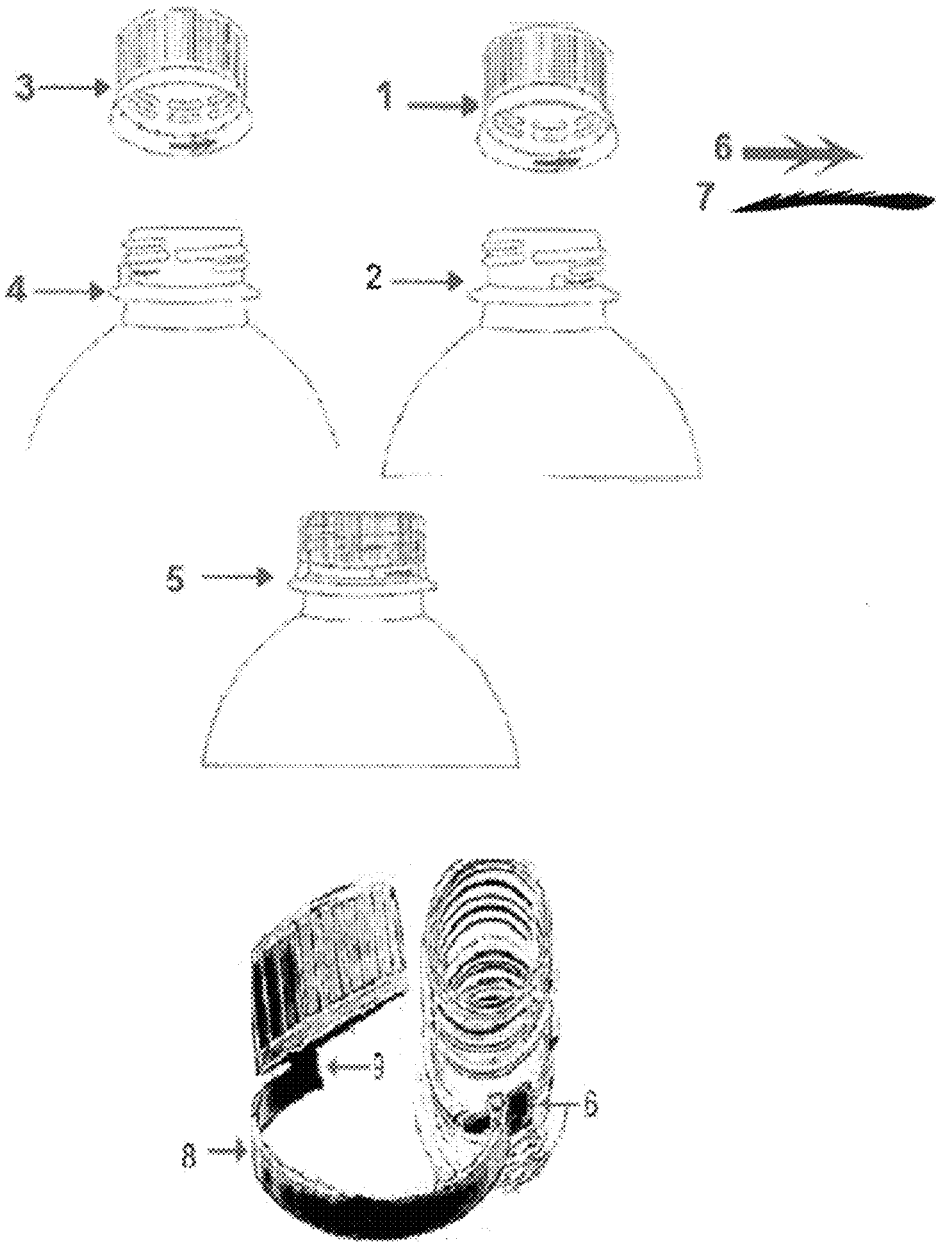
FIG. 1 shows the closure of a bottle to be sealed using a stopper provided with a safety strip with a ridge provided with lateral ends which move upon the entry of the safety strip into a part positioned on the container's neck.

FIG. 1 shows the closure of a bottle to be sealed. In the following, we will describe FIG. 1 and the numbers used therein:

(1) is the profile of the stopper with a ridge on a safety strip (positioned on an inner wall of a safety seal band of the stopper) which forms a safety element when entering into a part (e.g. receptacle) positioned on the container's neck. With regard to FIG. 1, the left side of the safety strip is attached to the safety seal band, e.g. next to an opening breaking point, and the right side of the safety strip is a free end.

(2) is a front view of the part on the container's neck and how it is entered by the ridge (e.g. moveable fins) of the safety strip present on the stopper.

(3) is a profile of the stopper of number (1).

(4) is a profile of the part on the container's neck and how it is entered by the ridge (e.g. moveable fins) of the safety strip present on the stopper.

(5) is a front view of the stopper positioned on the neck of the container in the final position upon its closure and entry of the ridge of the safety strip into the part positioned on the neck of the container.

(6) is a front view of a safety element formed by engagement of the part on the container's neck with the safety strip (the ridge) of the stopper, wherein the lateral ends of the ridge (e.g. moveable fins) which move upon the entry of the ridge into part return to their initial position after the safety strip entered the part, so that the entry is one way. The safety strip is provided on one end of the safety seal band.

(7) is a profile of the safety strip (the ridge) of the stopper.

(8) is a safety seal band attaching the bottle stopper to the container.

(9) shows opening breaking points on the safety seal band which are also provided on an upper edge of the safety seal band.

Figure 2:
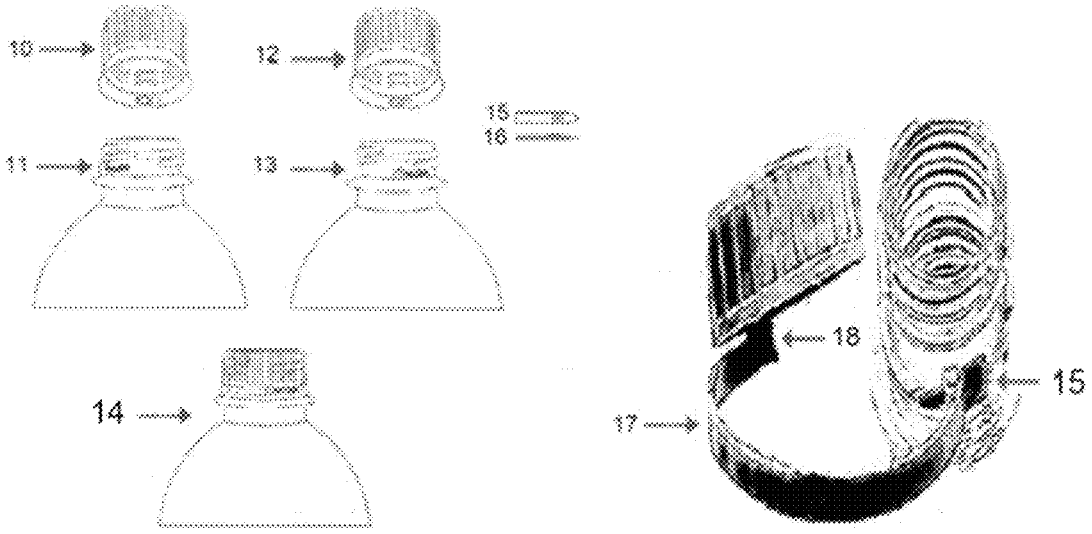
FIG. 2 shows the closure of a bottle to be sealed using a stopper provided with a safety strip with a ridge and grooves, wherein the safety strip enters into the part positioned on the container's neck.

FIG. 2 shows a closure method of the bottle to be sealed with a different shape of the ridge used on the safety strip of the stopper. Herein below we will describe FIG. 2 and the numbers used therein:

(10) is the profile of the stopper with the ridge (e.g. arrangement of the ridge(s) and groove(s)) on the safety strip (positioned on an inner wall of a safety seal band of the stopper) which enters into the part positioned on the container's neck thereby forming a safety element via engagement of the safety strip and the part. With regard to FIG. 2, the left side of the safety strip is attached to the safety seal band, e.g. next to an opening breaking point, and the right side of the safety strip is a free end.

(11) is a profile of the part on the container's neck and how it is entered by the ridge (ridge(s) and groove(s)) of the safety strip present on the stopper.

(12) is a profile of the stopper like number (10).

(13) is a front view of the part on the container's neck and how it is entered by the ridge (i.e. ridge(s) and groove(s)) of the safety strip provided on the stopper.

(14) is a front view of the stopper positioned on the neck of the container in the final position upon its closure and entry of the ridge of the safety strip into the part positioned on the neck of the container.

(15) is a front view of the safety element formed by engagement of the part of the bottle's neck and the safety strip (having the ridge(s) and groove(s)) of the stopper, with the relative difference in the arrangement of the ridge and groove positioned on the safety strip of the stopper. The difference is the place of the groove and ridge: instead of being on the sides of the safety strip as in FIG. 1, they are on the back; the corresponding engagement features of the part positioned on the container neck have been changed according to the change of the safety strip that enters into the part positioned on the container neck.

(16) is a profile of the safety strip (the ridge(s) and groove(s)) of the stopper.

(17) is a safety seal band attaching the bottle stopper to the container.

(18) shows opening breaking points on the safety seal band which are also provided on an upper edge of the safety seal band.

Figure 3:
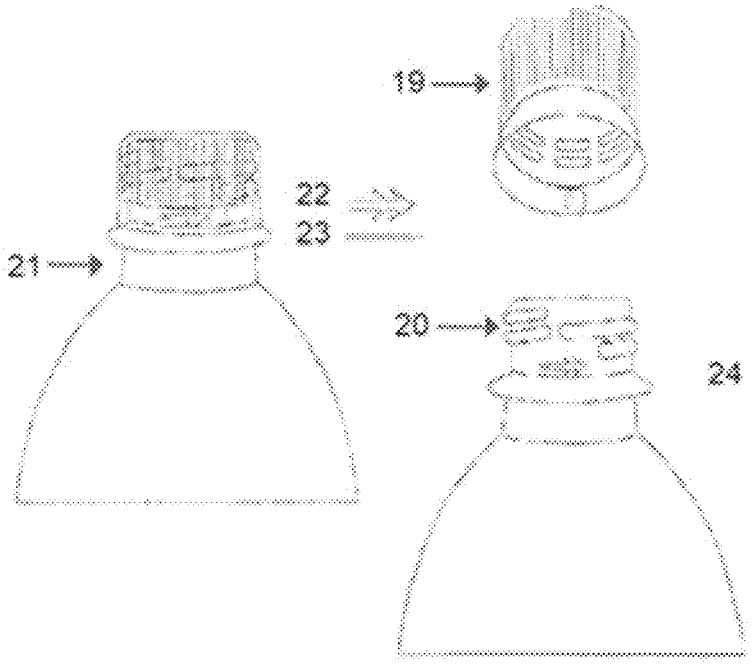
FIG. 3 shows the closure of a bottle to be sealed in another configuration using a stopper provided with a part, wherein a safety strip of the bottle's neck has a ridge and grooves and wherein the safety strip enters into the part positioned on the stopper.
Figure 3:
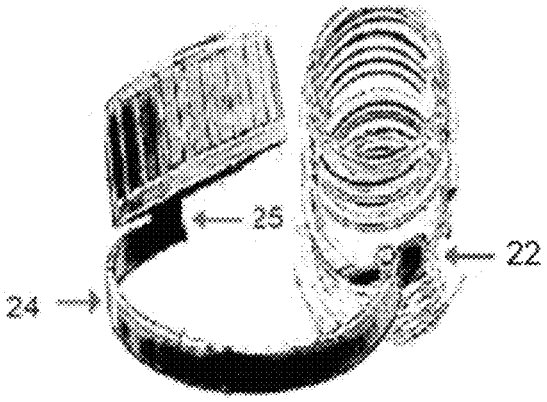

FIG. 3 shows a closure method of the bottle to be sealed by changing the place of the safety strip and the part used in the stopper and the bottle's neck. In the following, the numbers used in FIG. 3 will be described:

(19) is a front view of the part (positioned on an inner wall of a safety seal band of the stopper) for receiving the safety strip. Contrary to part number (1) in FIG. 1 in which the safety strip (the ridge) is on the stopper and the part is on the container, the part is on the stopper (the safety seal band thereof) and the safety strip is on the container's neck. The part is e.g. attached to the safety seal band next to an opening breaking point.

(20) is a front view of safety strip (the ridge) on the container's neck that enters into the part positioned on the safety seal band of the stopper in contradiction to part (2) in FIG. 1 in which the ridge is on the safety strip of the stopper and the part is on the neck of the container. With regard to FIG. 3, the left side of the safety strip is attached to the container's neck and the right side of the safety strip is a free end.

(21) is a front view of the stopper for its final position on the neck of the container in the closed position when the safety strip (the ridge) enters into the part in the stopper thereby forming the safety element. The moving part is the stopper and the fixed one is the safety strip (the ridge) on the neck of the container. Thus, the moveable part of the stopper surrounds the ridge contrary to FIG. 1 where the safety strip (the ridge) is movable and it enters into the part mounted on container's neck.

(22) is a front view of the safety strip (the ridge) on the container's neck.

(23) is a profile of the safety strip (the ridge) which is on the neck of the container.

(24) is a safety seal band attaching the bottle stopper to the container.

(25) shows opening breaking points on the safety seal band which are also provided on an upper edge of the safety seal band.

Figure 4:
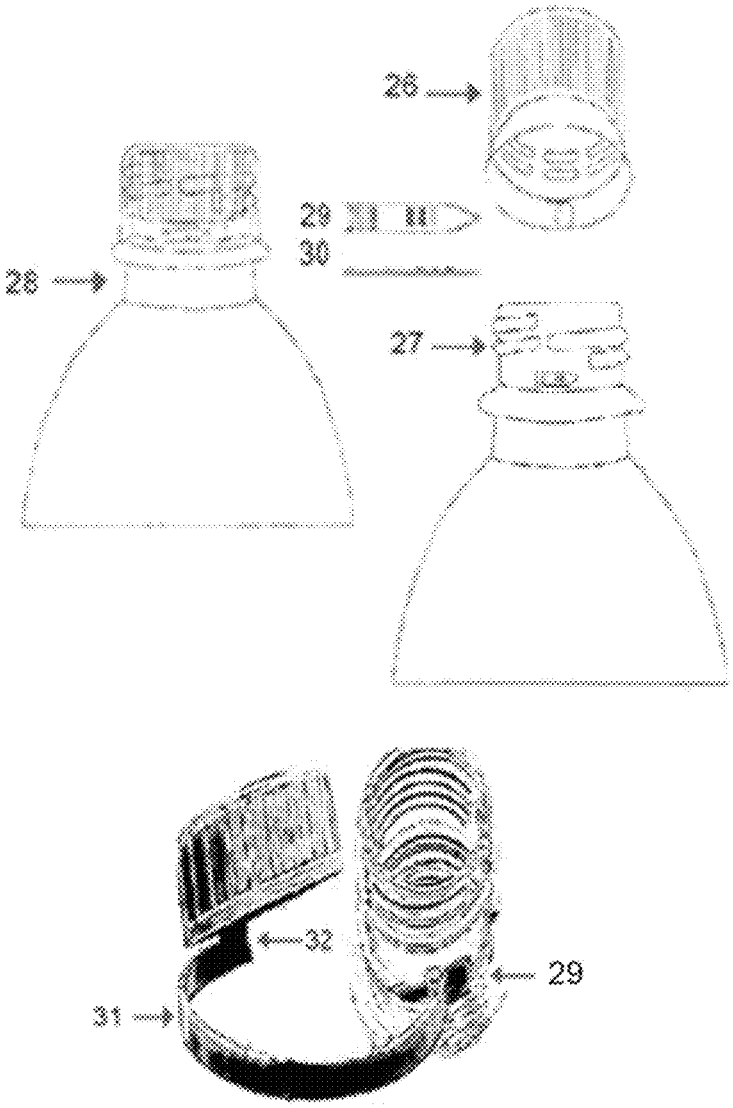
FIG. 4 shows closure of a bottle to be sealed via engagement using a stopper provided with a part entered by a safety strip of the bottle's neck, wherein a ridge and grooves are provided on the safety strip.

FIG. 4 shows a closure method of the bottle to be sealed with a different shape of the ridge provided on the safety strip present on the bottle's neck and by varying the place of the part to be entered by the ridge since in the present case it is on the stopper. In the following, the numbers of FIG. 4 will be described:

(26) is a front view of the part on the stopper (positioned on an inner wall of a safety seal band of the stopper) that gets entered by the safety strip (the ridge) present on the container's neck. The part is e.g. attached to the safety seal band next to an opening breaking point.

(27) is a front view of the safety strip (the ridge) on the container's neck that enters into the part positioned on the stopper with the relative difference in the place of the ridge and groove instead of being on the sides of the safety strip as in FIGS. 1 and 3 they are on the back. As for the part of the stopper, the place of the corresponding engagement features is changed according to the change of the safety strip (the ridge) that enters into the part of the stopper. With regard to FIG. 4, the left side of the safety strip is attached to the container's neck and the right side of the safety strip is a free end.

(28) is a front view of the stopper for its final position on the neck of the container in the closed position when the safety strip enters into the part of the stopper thereby forming the safety element so that the moving part is the part of the stopper and the fixed part is the ridge on the neck of the container.

(29) is a front view of the safety strip (the ridge) present on the container's neck.

(30) is a profile of the safety strip (the ridge) present on the neck of the container. The safety strip (1, 3) shown in FIG. 1 is represented by an arrow and is attached to the safety seal band present on the stopper from the left end and the remaining part is detached from the safety seal band so that it enters into the part on the neck of the container, thereby the aimed goal can be achieved which is the integration of two bodies together (the stopper and the neck of the container) by forming the safety element such that they become one non-detachable part (e.g. the safety element) unless the stopper or both parts are tampered with.

(31) is the safety seal band attaching the bottle stopper to the container.

(32) shows opening breaking points on the safety seal band which are also provided on an upper edge of the safety seal band.

Figure 5:
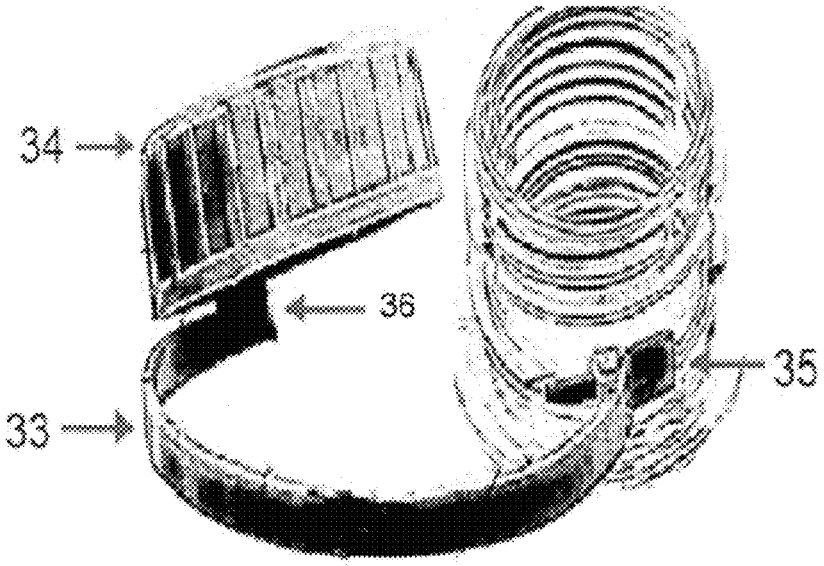
FIG. 5 shows a stopper still attached to a bottle after opening the bottle by a safety seal band on its end which is attached to the whole circumference of the stopper when closed, wherein the safety seal band partially detaches upon opening the bottle and wherein the safety seal band partially detaches from the stopper at opening breaking points keeping the stopper attached to the container.

FIG. 5 shows the bottle stopper attached to a safety seal band on its end in which it is attached to the whole circumference of the stopper when closed, wherein the safety seal band partially detaches upon opening the bottle from opening points keeping the stopper attached to the container. In the following, the numbers of FIG. 5 will be described:

(33) is a profile of the safety seal band in an open position in which one end is attached to the stopper and the other end is the safety strip while it (the safety strip) is engaged into a part on the neck of the container.

(34) is a profile of the stopper partially attached to the safety seal band upon opening keeping the stopper attached to the container.

(35) is a profile of the safety strip engaged into the container part thereby forming the safety element and attaching the stopper and the safety seal band to the container.

(36) shows opening breaking points on the safety seal band which are also provided on an upper edge of the safety seal band.

Although FIG. 5 shows that the safety strip is positioned on the safety seal band of the stopper and the part is positioned on the container's neck (e.g. as in FIGS. 1 and 2), the interchanged arrangement of the safety strip (e.g. arrow shaped and/or with the groove(s) and ridge(s)) and the part is also encompassed by FIG. 5.

The ridge contains moving parts as fins that fold upon entry into the part of the neck, then they open inside to prevent exit of the ridge without disrupting the safety strip, such fins or moving parts of the ridge are positioned on the sides. However, the safety strip (the ridge) (10, 12) shown in FIG. 2 has a different shape together with an appropriate difference in the shape of the part in the neck of the container.

The difference is that the ridge, i.e. moving parts that lead to closure of the stopper with the neck of the container, are not positioned on the sides of the ridge, but they have the same functions in a different way and they may have different various shapes, achieving the same role of absolute closure.

The part (2, 4) shown in FIG. 1 is positioned on the container's neck to be entered by the ridge of the safety strip of the stopper in a one-way direction. The part (11, 13) shown in FIG. 2 present on the neck of the container is entered by the ridge of the safety strip in a different shape, which is appropriate with the shape of the ridge which differs in FIGS. 1 and 3.

Using the tight closure method can be achieved as shown in FIG. 1, also showing the final shape upon closure (5) and how the ridge enters into the part of the neck in its final stages, so that safe closure is achieved since the ridge enters into the part in one irreversible way, whereby the safety strip of the stopper can be cut or torn upon opening of the container, so that they are non-detachable from one another in any way unless the stopper is tampered with and the safety strip is cut or torn, because it is impossible to reach the safety element (part and safety strip engaged with one another) as it is positioned between the stopper's wall and the wall of container's neck.

The present invention discloses a closure method and a bottle using a safety element formed by a safety strip (the ridge) that enters into a part of the container in neck or of the stopper and keeping products safe as required. The safety element takes two different shapes, so the position of the safety strip can be on the stopper or on the container's neck as shown in FIG. 3 such that it is present on the container's neck (20) with its rear (left) end contacting the neck of the container, being separated from the neck of the container by its front part (right end) such that it can enter the part positioned on the safety seal band present on the stopper.

The invention claimed is:

1. Safe and sealed closure method for a bottle, wherein a stopper (1, 12, 19, 26) used and a container (2, 13, 20, 27) to be closed are such that they form one integral part (5, 14, 28) upon closing of the container with the stopper via engagement so that the stopper (1, 12, 19, 26) is engaged with the container (2, 13, 20, 27) by (a) entry of a safety strip (6, 15) of said stopper into a part (4, 11) positioned on a neck of the container such that the safety strip enters into the part of the neck of the container in one irreversible way, making the safety strip and the part one integral, non-detachable part unless the stopper is tampered and the safety strip is cut, since the safety strip cannot be reached due to its location between a wall of a safety seal band (25) of the stopper and a wall of the neck of the container and the safety strip cannot be reused after closure in production stage; or (b) entry of a safety strip (22, 29) positioned on the neck of the container into a part (19, 26) of said stopper such that the safety strip enters into the part of the stopper in one irreversible way, making the safety strip and the part one integral, non-detachable part unless the stopper is tampered and the safety strip is cut, since the safety strip cannot be reached due to its location between the wall of a safety seal band (25) of the stopper and the wall of the neck of the container and the safety strip cannot be reused after closure in production stage, wherein said safety strip or said part is attached to said safety seal band (25) of the stopper at an end of the safety seal band, wherein the safety seal band is attached to the whole circumference of the stopper when closed and wherein the safety seal band partially detaches from the stopper, and remains attached to said safety strip or said part at the end of the safety seal band, upon opening the bottle from opening points keeping the stopper attached to the container.

2. The method according to claim 1, wherein said safety strip (6, 15, 22, 29) comprises a ridge that is shaped as an arrow (6, 22) with moveable fins present on sides (6, 22) or on the back of said ridge (15, 29) such that the fins fold when entering the part of the container neck or the part of the stopper (2, 13, 20, 27) and then open again inside the part in order to prevent the exit of the safety strip without disrupting the safety strip.

3. The method according to claim 1, wherein said safety strip comprises (6, 15, 22, 29) a ridge shaped as an arrow with unmovable fins attached thereto, whereby the part of the container neck or of the stopper is movable such that when the fins enter therein the part opens and comes back to its natural closed position after the entry of the fins, making it impossible for the safety strip to exit unless the safety strip is tampered.

4. Bottle, the bottle having a container (2, 13, 20, 27) and a stopper (1, 12, 19, 26) with a safety seal band (25), wherein the container (2, 13, 20, 27) is provided with a neck, wherein one of the container's neck and the stopper is provided with a safety strip, and wherein the other of the container's neck and the stopper is provided with a part for cooperation with the safety strip, wherein the safety strip is configured to irreversibly enter said part and wherein, when the stopper closes the container, the part and the safety strip entering said part are arranged between a wall of the container's neck and a wall of the safety seal band (25), and wherein the stopper is configured to close the container (2, 13, 20, 27) such that the stopper (1, 12, 19, 26) and the container (2, 13, 20, 27) to be closed form one integral part (5, 14, 21, 28) via engagement so that the stopper (1, 12, 19, 26) is engaged with the container (2, 13, 20, 27) by (a) entry of the safety strip (6, 15) of said stopper into the part (4, 11) positioned on the container's neck such that the safety strip enters into the part in one irreversible way, making the safety strip and the part one integral, non-detachable part unless the stopper is tampered and the safety strip is cut, since the safety strip cannot be reached due to its location between a wall of the safety seal band (25) of the stopper and a wall of bottle's neck, and the safety strip cannot be reused after closure in production stage; or (b) entry of the safety strip (22, 29) positioned on the container's neck into the part (19, 26) of said stopper such that the safety strip enters into the part in one irreversible way, making the safety strip and the part one integral, non-detachable part unless the stopper is tampered and the safety strip is cut, since the safety strip cannot be reached due to its location between a wall of the safety seal band (25) of the stopper and a wall of bottle's neck, and the safety strip cannot be reused after closure in production stage, wherein said safety strip or said part is attached to said safety seal band (25) of the stopper at an end of the safety seal band, wherein the safety seal band is attached to the whole circumference of the stopper when closed and wherein the safety seal band partially detaches from the stopper, and remains attached to said safety strip or said part at the end of the safety seal band, upon opening the bottle from opening points keeping the stopper attached to the container.

* * * * *